United States Patent [19]

Coronado

[11] Patent Number: 4,832,120

[45] Date of Patent: May 23, 1989

[54] INFLATABLE TOOL FOR A SUBTERRANEAN WELL

[75] Inventor: Martin P. Coronado, Houston, Tex.

[73] Assignee: Baker Hughes Incorporated, Houston, Tex.

[21] Appl. No.: 138,197

[22] Filed: Dec. 28, 1987

[51] Int. Cl.[4] ..... E21B 33/127

[52] U.S. Cl. ..... 166/187; 277/34

[58] Field of Search ..... 166/387, 123, 181, 182, 166/187, 323, 374; 277/3, 34, 34.3, 34.6

[56] References Cited

U.S. PATENT DOCUMENTS

| | | | |
|---|---|---|---|
| 3,160,211 | 12/1964 | Malone | 166/187 |
| 3,606,924 | 9/1971 | Malone | 166/187 |
| 4,349,204 | 9/1982 | Malone | 166/187 X |
| 4,424,861 | 1/1984 | Carter, Jr. et al. | 166/187 X |
| 4,655,292 | 4/1987 | Halbardier | 166/187 X |

*Primary Examiner*—William P. Neuder

*Attorney, Agent, or Firm*—Hubbard, Thurman, Turner & Tucker

[57] ABSTRACT

A conventional inflatable packer or bridge plug incorporates a reinforced sleeve of elastomeric material mounted in surrounding relationship to a tubular body and having one end of the sleeve fixed and sealably secured to the tubular body and the other end sealably and slidably affixed to the tubular body. In accordance with the invention, the other end is shearably secured to the tubular body so that a predetermined amount of axial tension must be produced in the inflatable element prior to releasing the other end of said element for axial movement relative to the tubular body, which results in a more uniform radial inflation of the inflatable element.

3 Claims, 3 Drawing Sheets

INFLATABLE TOOL FOR A SUBTERRANEAN WELL

BACKGROUND OF THE INVENTION

1. FIELD OF THE INVENTION

The invention relates to an improved inflatable packer or bridge plug for use in subterranean wells.

2. SUMMARY OF THE PRIOR ART

Inflatable packers (or bridge plugs) have long been utilized in subterranean wells. Such inflatable tools normally comprise an elastomeric sleeve element mounted in surrounding relationship to a tubular body portion. Pressured fluid is communicated from the surface of the well to the bore of the tubular body and thence through radial passages to the interior of an inner elastomeric sleeve. Such inner elastomeric sleeve is completely surrounded and secured relative to a plurality of peripherally overlapping, resilient, reinforcing slats or ribs. The medial portions of the reinforcing ribs are surrounded and bonded to an outer annular elastomeric packing element of substantially greater wall thickness. Normally, an upper securing assembly wedgingly engages the upper end of the inner elastomeric sleeve with the reinforcing slats and are fixedly and sealably secured relative to the central tubular body, while a lower securing assembly i sealably secured to a sealing sub which is mounted for slidable and sealable movements on the exterior of the central tubular body, in response to the inflation forces. A structure of this general type is shown in U.S. Pat. No. 3,160,211 to MALONE.

With inflatable tools of this type, it has been observed that the upper end of the reinforced inner elastomeric sleeve was expanding prior to the medial cover portions and becoming deformed, resulting in high local stresses. Such deformation occurs because the uncovered anchor ends of the inner elastomeric sleeve element expands with much less pressure than the medial portions of such sleeve element which are reinforced against expansion by the thick walled elastomeric packing sleeve. Such premature expansion of the upper end of the inflatable elements of the prior art inflatable packers resulted in an inward movement of the opposite end of the elastomeric cover sleeve, forcing the inner elastomeric sleeve into sealing relationship with the exterior of the tubular central body and thus preventing passage of the pressured fluid employed for expanding the inflatable inner elastomeric sleeve from reaching the lower portions of such sleeve. A further reason for the premature expansion of the upper end of the inner elastomeric sleeve of the inflatable packing assemblage lies in the fact that any inflation movement of the lower portions of the inflatable elements results in an immediate axial displacement of the lower securing assembly relative to the stationary tubular central body. Thus, the stress in the lower portions of the packing assemblage is substantially relieved by such axial movement, while the fluid pressure works on the upper portion of the inner elastomeric sleeve to deform it radially outwardly.

It has also been observed that both the upper and lower end portions of the inner sleeve expand prior to the medial portions, thus causing fluid to be trapped around the cover sleeve. Subsequent leakage of such trapped fluid will permit the cover to expand, reducing the inflation pressure and setting the stage for fluid leakage past the cover element.

SUMMARY OF THE INVENTION

The elimination of the above described defective performance of the prior art inflatable packers or bridge plugs is the primary object of this invention. While this invention utilizes a central tubular body around which is sealingly mounted an inner elastomeric sleeve, which in turn is surrounded by peripherally overlapped, reinforcing slats or ribs and an outer elastomeric cover sleeve, this invention contemplates that the securing assembly at the lower end of the prior art packing assemblage will not be immediately free to move axially in response to inflation forces produced through the introduction of pressured fluid to the interior of the inner elastomeric sleeve, but will be shearably anchored to the tubular central body until a pre-determined tensile stress is introduced into all of the elements forming the inflatable assemblage, and particular that a tensile stress is introduced into the reinforcing slats.

With such pre-stressing of all elements of the inflatable packing assemblage, there is far less tendency for the upper portion of the inflatable packing assemblage to radially expand prior to other lower portions thereof. When the predetermined degree of axial tension is achieved in the elements of the inflatable assemblage, the shearable means holding the lower securing means against axial movement will be sheared and the inflatable packing assemblage will be free to expand outwardly, with all portions of the assemblage moving radially outwardly at substantially the same time until the outer elastomeric packing sleeve or cover engages the inner wall of the conduit within which the inflatable packer is to be installed.

Further advantages of the invention will be readily apparent to those skilled in the art from the following detailed description, taken in conjunction with the annexed sheets of drawings, on which is shown a preferred embodiment of the invention.

DESCRIPTION OF PREFERRED EMBODIMENT

Figure 1A:
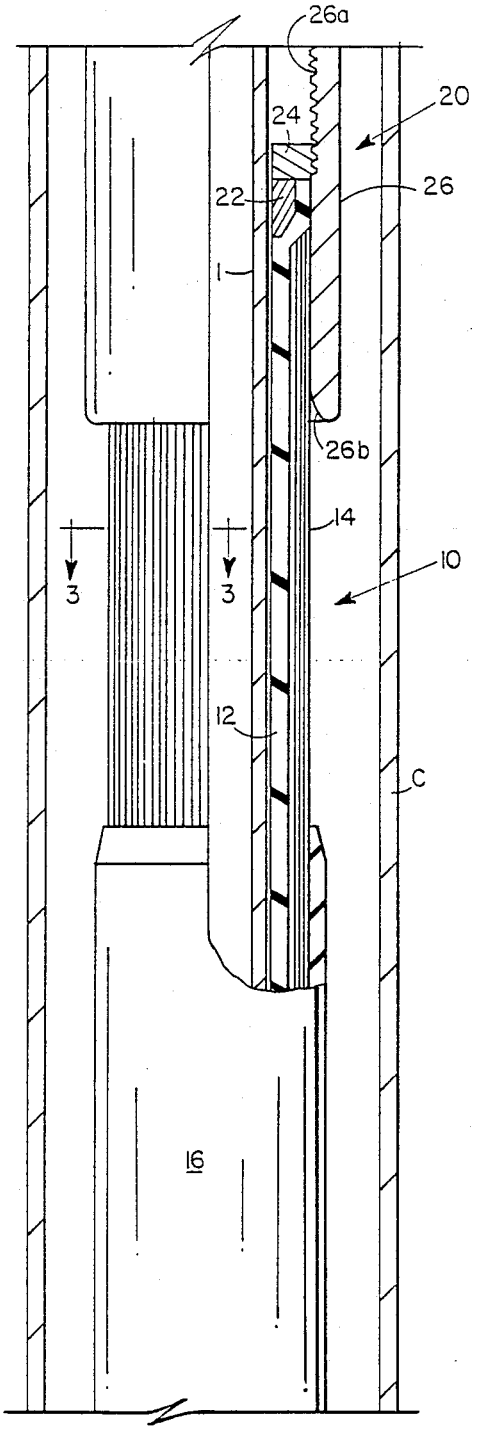
FIGS. 1A and 1B collectively constitute a vertical quarter sectional view of an inflatable tool embodying this invention, with the elements shown in their run-in positions.
Figure 1B:
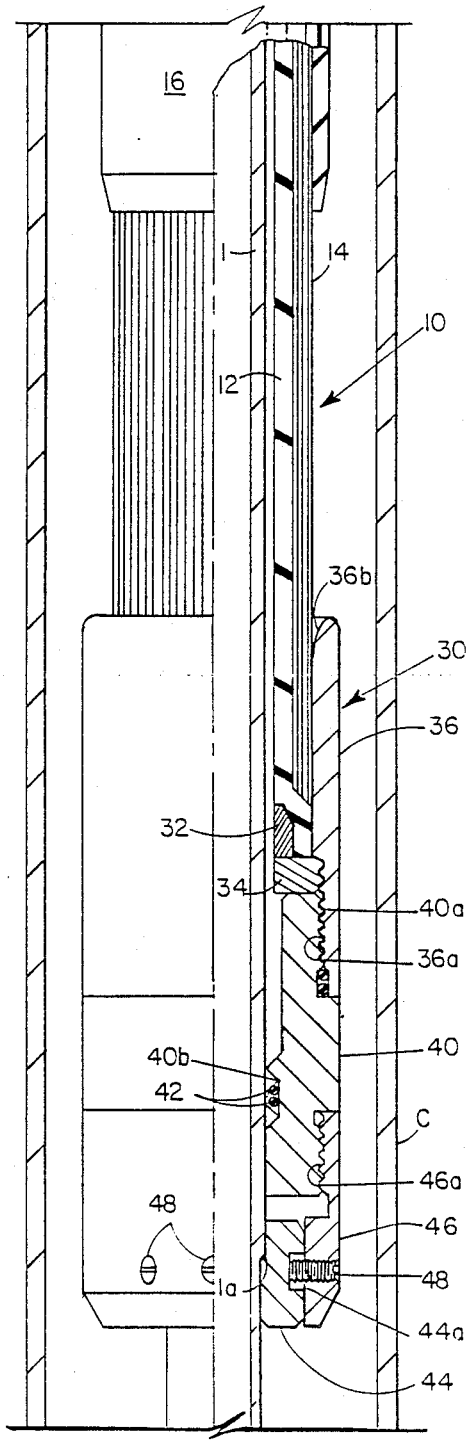
Figure 2A:
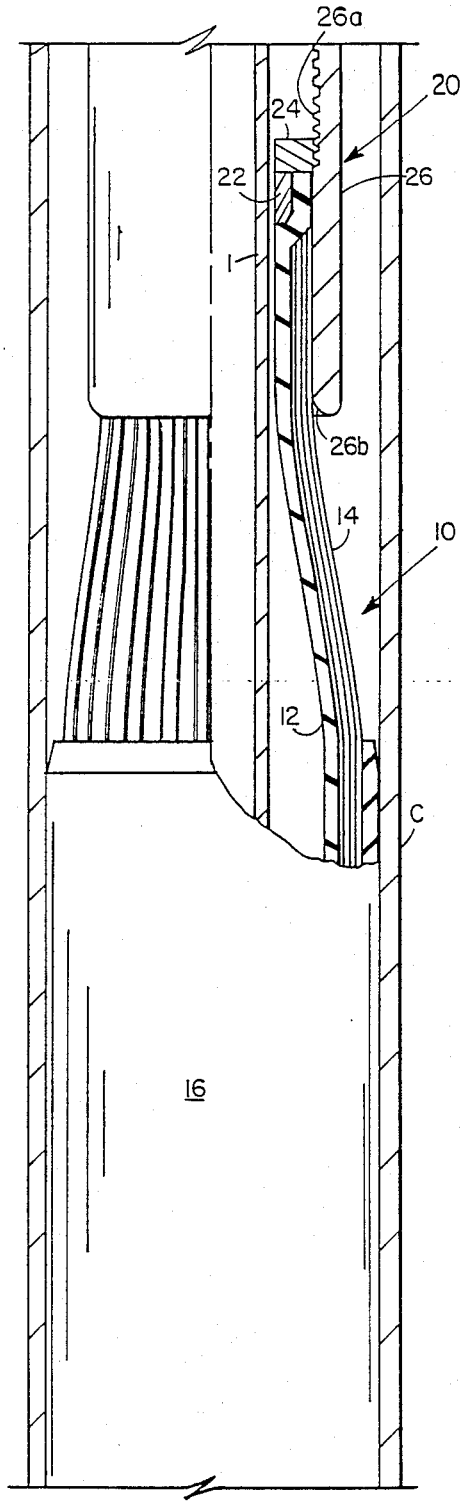
FIGS. 2A and 2B are views respectively similar to FIGS. 1A and 1B, but showing the elements of the inflatable tool in the positions occupied after the introduction of pressured fluid to effect the expansion of the inflatable elements.
Figure 2B:
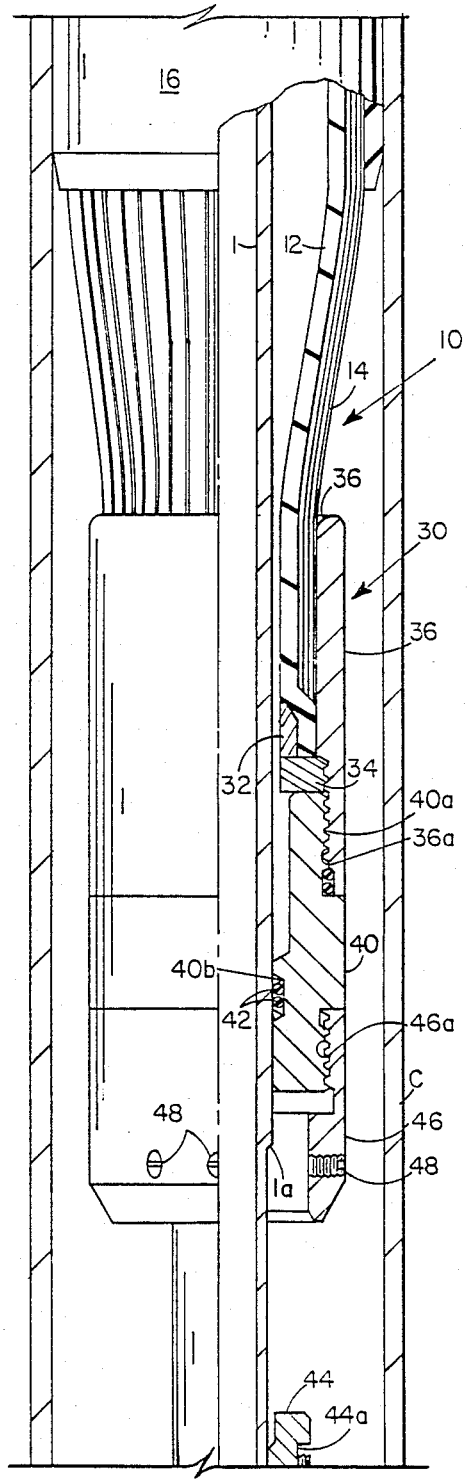

Referring to FIGS. 1A and 1B, there is shown the inflatable portion of an inflatable tool which can comprise a packer or bridge plug, depending upon whether or not the bore of the tool is open or closed. Detailed descriptions of inflatable packers or bridge plugs may be found in co-pending application, Ser. No. 877,421, filed June 23, 1986, and Ser. No. 112,888 filed Oct. 23, 1987, both of which applications being assigned to the assignee of this application.

The inflatable element 10 embodying this invention is mounted in surrounding relationship to a central body sleeve 1 which extends through the full length of the packer and connects to the bottom of coiled tubing which extends to the well surface. Inflation pressures are supplied through the bore of the body sleeve to the inflatable element 10 through valving arrangements specifically described and illustrated in the above referred to co-pending applications, the disclosures of which are incorporated herein by reference.

Figure 3:
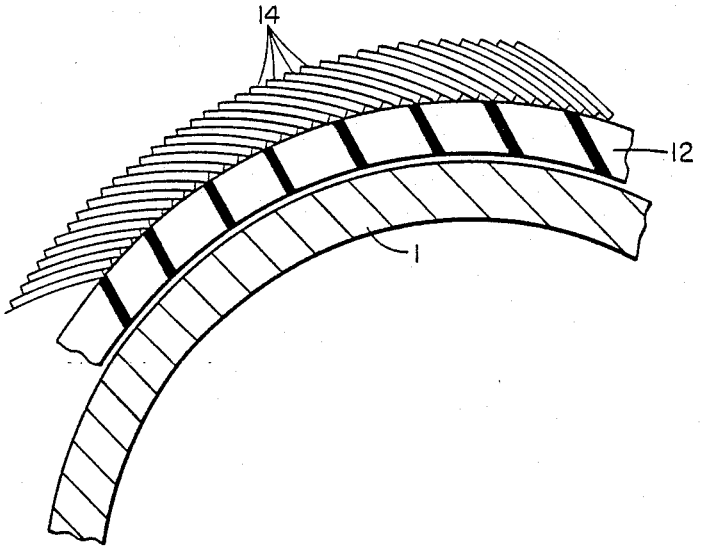
FIG. 3 is an enlarged scale partial sectional view taken on the plane 3—3 of FIG. 1A.

The inflatable element 10 comprises an inner elastomeric sleeve 12 which is disposed in surrounding relationship to the central body sleeve 1. Sleeve 12 has a plurality of peripherally overlapping reinforcing ribs or slats 14 around its exterior and extending substantially the full length of the inflatable element 10. Each rib 14 is of arcuate cross-sectional configuration as best shown in FIG. 3 and such ribs shift relative to each other upon expansion or contraction of the sleeve 12. The packing element 16 which actually accomplishes the sealing engagement with the bore of a well conduit (or open hole) C comprises an outer elastomeric sleeve or cover which is bonded to the medial portions of the reinforcing ribs 14.

An upper anchoring assemblage 20 is provided for sealably anchoring the upper ends of the elastomeric sleeve 12 and the reinforcing ribs 14 relative to the central body sleeve 1. Such anchoring assemblage is of entirely conventional construction and includes a wedge element 22 which engages the top end of the inner elastomeric sleeve 12 and is forced into wedging engagement therewith by a wedge nut 24 which is engaged in internal threads **26*a* in a sleeve 26. Sleeve 26 is secured in position by being attached to the upper portions of the inflatable tool, in the manner described in the above referred to co-pending applications. The sleeve 26 overlies the upper ends of reinforcing ribs 14 and has a rounded lower surface 26*b* to accommodate the radial expansion of the adjacent portions of ribs 14. By virtue of such connections, the upper end of the inner elastomeric sleeve 12 and the reinforcing ribs 14 are sealably secured against axial movement relative to the central body sleeve 1**.

A lower anchoring assembly 30 is provided which is identical to the upper assemblage 20 with the exception that it is in reversed relationship. Thus, a wedge 32 is forced against the lower end of the inner elastomeric sleeve 12 by an externally threaded wedge nut 34 which cooperates with internal threads **36*a* provided in the lower end of the sleeve 36. The upper end of clamping ring 36 overlies the lower end of the reinforcing ribs 14, and is curved as shown at 36*b* to conform to the adjacent portions of ribs 14** when expansion occurs.

Lower clamping ring 36 is threadably secured to a seal sub 40 having external threads **40*a* cooperating with the lower end of the internal threads 36*a*. Seal sub 40 defines an internal recess 40*b* within which a pair of O-rings 42 are mounted which sealably engages the exterior surface of the central body sleeve 1. Thus, if the seal sub 40 is not restrained, then the lower end of the packing element 10 is free to move axially relative to the central body sleeve 1**.

In accordance with this invention, a temporary restraint is imposed on axial movement of the seal sub 40 by shearably securing such seal sub to the central body sleeve 1. Inner body sleeve 1 is preferably provided with a downwardly facing shoulder **1*a* against which a ring 44 is abutted. The ring 44 defines an external annular groove 44*a*. A shear adapter sleeve 46 has internal threads 46*a* cooperating with the bottom end of the seal sub 40, and the lower end of the shear adapter sleeve 46 overlies the shear ring 44. One or more shear screws 8 are provided in radial relationship to the shear adapter sleeve 46 and engage the annular groove 44*a* provided in the shear ring 44**.

With the aforedescribed arrangement, the lower end of the inner elastomeric sleeve 12 and the reinforcing ribs 14 cannot move axially so long as the shear screws 48 are intact. Thus the application of a pressured fluid to the inner bore of inner elastomeric sleeve 12 produces a substantial degree of tension in such sleeve, and particularly in the reinforcing ribs 14. When this tension reaches a pre-selected degree capable of effecting the shearing of shear pins 48, such pins are sheared and the lower mounting assembly 40 is free to move axially relative to the inner body sleeve 1, as shown in FIG. 1B.

With this arrangement, no substantial radial expansion of the packing element 10 will occur until the desired degree f tension is produced in the reinforcing ribs 14. With such arrangement, all portions of the inflatable element 10 will expand radially outwardly at substantially the same time, thus overcoming the problems of the prior art constructions enumerated above.

Those skilled in the art will appreciate that other forms of shearable connections may be utilized between the sealing sub 40 and the central body sleeve 1. For example, the shear screws 48 may be replaced by a shearable ring. In any event, no substantial radial expansion of the inner elastomeric sleeve 12, the reinforcing ribs 14 and the outer elastomeric packing sleeve or cover 16 will occur until the shearable connection between the seal sub 40 and the central body sleeve 1 is terminated.

Although the invention has been described in terms of specified embodiments which are set forth in detail, it should be understood that this is by illustration only and that the invention is not necessarily limited thereto, since alternative embodiments and operating techniques will become apparent to those skilled in the art in view of the disclosure. Accordingly, modifications are contemplated which can be made without departing from the spirit of the described invention.

What is claimed and desired to be secured by Letters Patent is:

1. An inflatable packing tool for use in a subterranean well conduit, comprising, in combination:

a central tubular body having means on its upper end for sealable connection to a tubular element extending to the well surface;

an annular inflatable packing element concentrically surrounding said central tubular body;

said annular inflatable packing element comprising an elastomeric sleeve having peripherally overlapped, axially extending reinforcing ribs secured relative to the exterior of the medial portion of said elastomeric sleeve;

and an elastomeric cover sleeve covering and bonded to the reinforcing ribs, thereby defining uncovered end portions of said elastomeric sleeve;

a first securing means engageable with said one end of said inflatable packing element for sealably securing said one end to said central tubular body;

a second securing means engageable with the other en of said inflatable body element for slidably and sealably securing said other end to said central tubular body;

fluid passage means communicating between the bore of said central tubular body and the interior of said annular inflatable packing element, whereby pressured fluid may be transmitted from the well surface to the interior of said annular inflatable packing element to expand said inflatable packing element into sealing engagement with the internal wall of the well conduit; and means for shearably securing said second securing means to said central tubular body to prevent axial movement of said second securing means in response to inflation forces produced by said pressured fluid until a preselected degree of axial tension is produced in both said uncovered end portions.

2. The apparatus of claim 1 wherein said means for shearably securing said second securing means comprises a downwardly facing external shoulder on said central tubular body adjacent said second securing means; a stop ring surrounding said central tubular body and abutting said downwardly facing shoulder; and shearable means securing said second securing means to said stop ring.

3. The apparatus of claim 2 wherein said shearable means securing said second securing means to said stop ring comprises a sleeve threadably secured in depending relation to said second securing means and surrounding said stop ring; and a shearable element connecting said sleeve to said stop ring.

* * * * *